US008702456B1

(12) United States Patent
Wang

(10) Patent No.: US 8,702,456 B1
(45) Date of Patent: Apr. 22, 2014

(54) COAXIAL CABLE ADAPTOR

(71) Applicant: JJS Communications Co., Ltd., Taipei (TW)

(72) Inventor: Shou-Ying Wang, Taipei (TW)

(73) Assignee: JJS Communications Co., Ltd., Taipei (TW)

( * ) Notice: Subject to any disclaimer, the term of this patent is extended or adjusted under 35 U.S.C. 154(b) by 0 days.

(21) Appl. No.: 13/778,492

(22) Filed: Feb. 27, 2013

(51) Int. Cl.

| | |
|---|---|
| ***H01R 11/22*** | (2006.01) |
| ***H01R 13/11*** | (2006.01) |
| ***H01R 9/05*** | (2006.01) |
| ***H01R 13/187*** | (2006.01) |
| *H01R 103/00* | (2006.01) |

(52) U.S. Cl.
CPC ..... *H01R 13/111* (2013.01); *H01R 9/05* (2013.01); *H01R 13/187* (2013.01); *H01R 2103/00* (2013.01)
USPC ..... 439/851; 439/578

(58) Field of Classification Search
USPC ..... 439/578, 638, 851
See application file for complete search history.

(56) References Cited

U.S. PATENT DOCUMENTS

| | | | | |
|---|---|---|---|---|
| 3,854,789 | A * | 12/1974 | Kaplan | 439/584 |
| 5,498,175 | A * | 3/1996 | Yeh et al. | 439/578 |
| 5,796,323 | A * | 8/1998 | Uchikoba et al. | 333/260 |
| 6,250,960 | B1 * | 6/2001 | Youtsey | 439/578 |
| 6,595,799 | B2 * | 7/2003 | Yao | 439/578 |
| 6,899,563 | B1 * | 5/2005 | Lee | 439/578 |
| 7,931,509 | B2 * | 4/2011 | Shaw et al. | 439/851 |
| 8,083,544 | B2 * | 12/2011 | Chee | 439/578 |

* cited by examiner

*Primary Examiner* — Neil Abrams
*Assistant Examiner* — Travis Chambers
(74) *Attorney, Agent, or Firm* — Bacon & Thomas, PLLC

(57) ABSTRACT

A coaxial cable adaptor comprises a body, a conductor disposed inside the body and insulation linings disposed between the body and the conducting tubular conductor. A plurality conducting plates separated by gaps is disposed at two ends of the tubular conductor respectively, and an accommodating groove is formed between the conducting plates at each of the two ends for inserting coaxial cable cores. Middle section areas of the conducting plates are depressed toward the accommodating groove, and an arch flange is protrudingly formed on the middle section area of each of the conducting plates facing towards the accommodating groove. Thereby, the coaxial cable cores inserted in the accommodating groove can be clamped tightly by the tubular conductor through the elasticity of the arch flanges of the conducting plates in order to allow stable transmittance of high frequency signals.

2 Claims, 3 Drawing Sheets

COAXIAL CABLE ADAPTOR

BACKGROUND OF THE INVENTION

1. Field of Invention

The present invention relates to a coaxial cable adaptor and more particularly to a coaxial cable adaptor with conducting plates, including an arch flange which protrudes inwardly on the middle section area of each of the conducting plates so that coaxial cable cores inserted in an accommodating groove can be clamped tightly by a tubular conductor through the elasticity of the arch flanges of the conducting plates in order to allow stable transmittance of high frequency signals.

2. Related Art

Coaxial cables are commonly used as signal transmitting lines for cable, satellite and internet systems to carry and transmit high frequency signals. A coaxial cable connector disposed at the end of said coaxial cable, is used for fastening with a corresponding connector onto a consumers video or internet device. The most popular F-type coaxial cable connector is used for connecting a coaxial cable and includes a rotatable annular nut disposed at a front end of the socket. A female screw thread is disposed on an inner surface of the annular nut, and an outer surface of the annular nut is formed in a hexagonal shape. Thereby, the coaxial cable connector can be fastened with the corresponding coaxial cable connector on the consumer's video or internet device by rotating and tightening with fingers or a clamping tool.

When installing coaxial cables, adaptors are commonly used to mechanically connect different cables. Generally, an adaptor used with the F-type coaxial cable connector comprises conductive outer male screw threads disposed at two ends of a body of the adaptor, a conductive terminal axially disposed inside the body and insulation linings disposed between the conductive terminal and the conductive outer male screw threads. A clamping end is disposed at each of two ends of the conductive terminal. Each of the clamping ends has a plurality of elastic plates separated by gaps. An inner diameter of an opening of each of the clamping ends is reduced axially and inwardly to form a convergent portion. Thereby, when different coaxial cables are coupled with the two ends of the adaptor, a coaxial cable center conductive core is clamped by the elastic plates of the clamping ends respectively so that the coaxial cables at the two ends of the adaptor are electrically connected with each other.

The above mentioned adaptor is not merely used as a coupling element for coupling different coaxial cables, it is also used as a transmitting element for performing electronic transmission between different sizes of coaxial cables. In such cases, unstable coupling of different size cables will have a negative effect on the electric transmission of signals. Because the connection between the conductive terminal and the coaxial cable cores is achieved by clamping the cores between the elastic plates, inserting and unplugging the center conductor cores, will result in elastic fatigue, especially after the inserting and unplugging of cores with different diameters. As a result, the electrical connection is poor and a loss of high frequency output efficiency will occur.

SUMMARY OF THE INVENTION

In order to maintain a stable coupling between different coaxial cables an adaptor is needed which will result in high quality electrical connections, even after inserting and unplugging of coaxial cables on numerous occasions, a coaxial cable adaptor of the present invention is disclosed in the present invention.

A primary objective of the present invention is to provide a secure coaxial cable adaptor, by using an arch flange protrudingly formed on a middle section area of each of conducting plates of a tubular conductor, whereby coaxial cable cores can be clamped elastically and tightly by the arch flanges on the conducting plates at each end of the tubular conductor when the coaxial cable cores are inserted in an accommodating groove of the tubular conductor.

In order to achieve the above-mentioned objectives, a coaxial cable adaptor of the present invention comprises a body, a tubular conductor disposed inside the body and insulation linings disposed between the body and the tubular conductor. A plurality of conducting plates separated by gaps is disposed at two ends of the tubular conductor respectively, and an accommodating groove is formed between the conducting plates at each of the two ends for inserting coaxial cable cores. Middle section areas of the conducting plates are depressed toward the accommodating groove, and an arch flange is protrudingly formed on the middle section area of each of the conducting plates facing towards the accommodating groove. Thereby, the coaxial cable cores inserted in the accommodating groove can be clamped tightly by the tubular conductor through the elasticity of the arch flanges of the conducting plates After the coaxial cables are coupled with the coaxial cable adaptor of the present invention, the coaxial cable cores can be stably connected inside the tubular conductor for maintaining good electrical connections and achieving better efficiency of high frequency transmission.

The present invention will become more fully understood by reference to the following detailed description thereof when read in conjunction with the attached drawings.

DETAILED DESCRIPTION OF THE INVENTION

Figure 1:
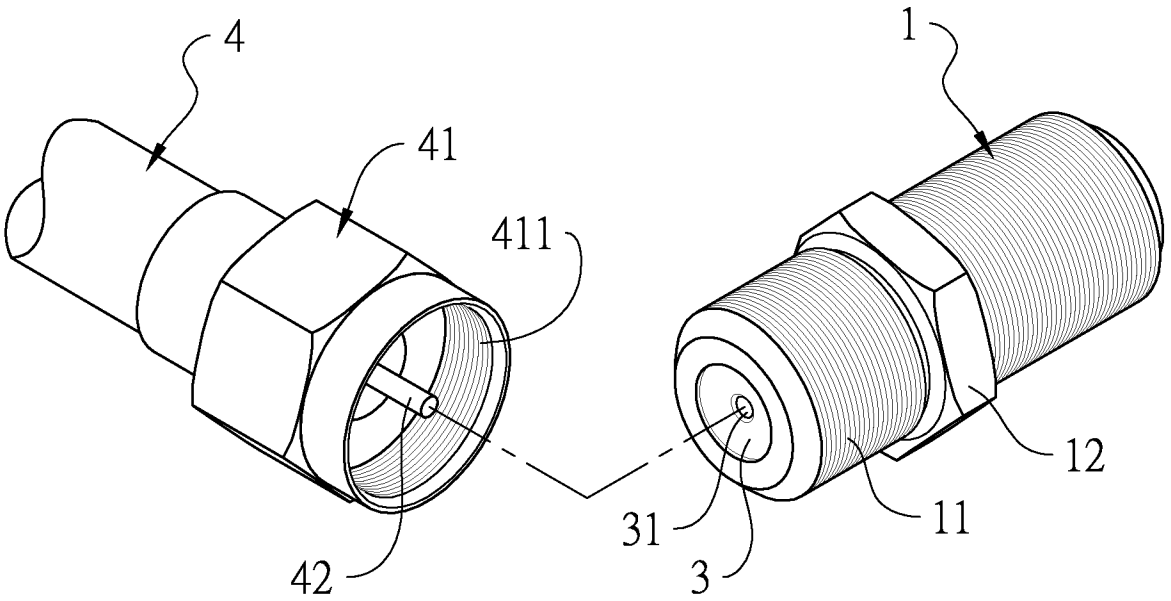
FIG. 1 is a perspective view of a coaxial cable adaptor according to an embodiment of the disclosure.
Figure 2:
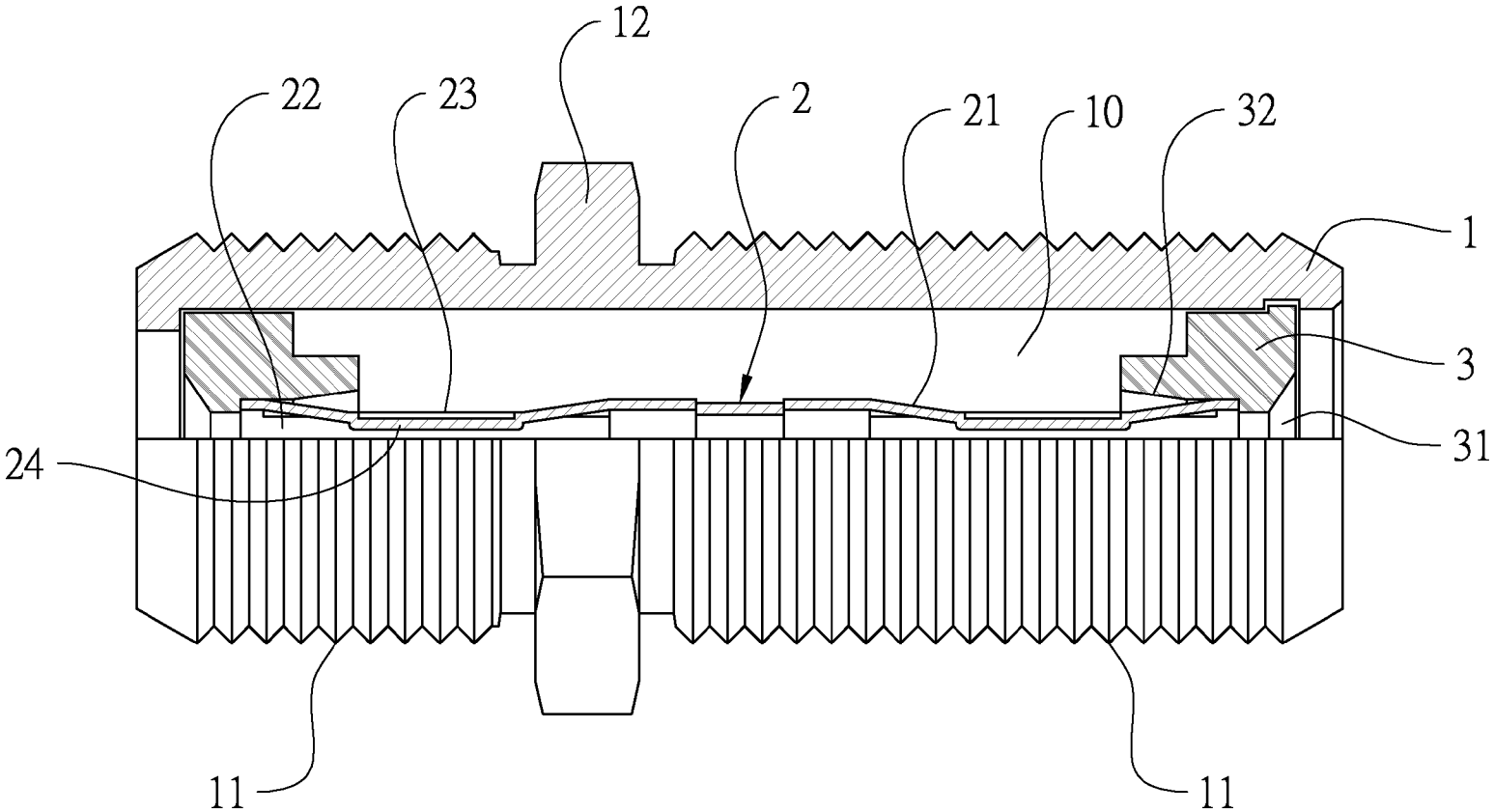
FIG. 2 is a sectional view of the embodiment in FIG. 1.

Please refer to FIGS. 1 and 2, which are related to a coaxial cable adaptor according to an embodiment of the disclosure. The coaxial cable adaptor comprises a body 1, a tubular conductor 2 axially disposed inside the body 1 and two insulation linings 3.

The body 1 is made of a conductive material, an axial passage 10 is formed inside the body 1, and a male screw thread 11 is disposed on an outer circumference of the body 1 near two opposite ends. The male screw thread 11 is corresponded to an inner female thread 411 of a connector 41 disposed at a front end of a coaxial cable 4. A flange 12 is disposed between two areas of the male screw thread 11.

The two insulation linings 3 are disposed at two ends of the tubular conductor 2 respectively. A through hole 31 is disposed at a center of each of the insulation linings 3. A guiding portion 32 extended inwardly and axially with a gradually increasing inner diameter is disposed by the through hole 31, and one of the ends of the tubular conductor 2 is pressed against inside the guiding portion 32. Thereby, when the tubular conductor 2 and the insulation linings 3 are placed inside the passage 10 of the body 1, the tubular conductor 2 can be fixed and supported inside the passage 10 of the body 1.

Figure 3:
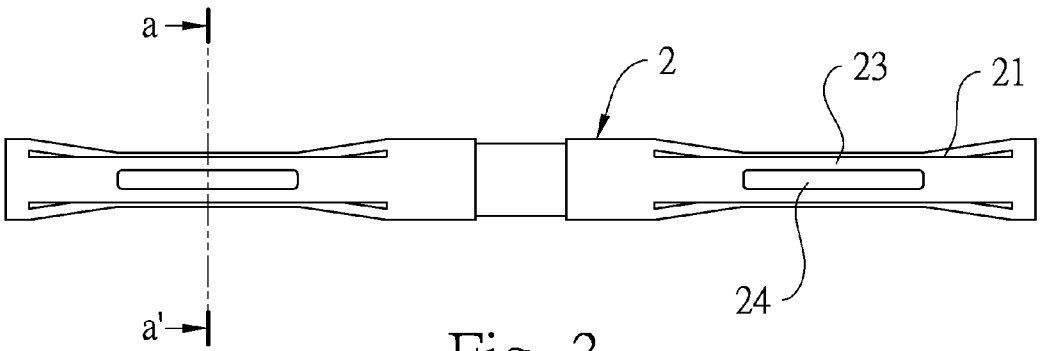
FIG. 3 is a schematic view of a tubular conductor in the embodiment in FIG. 1.
Figure 3A:
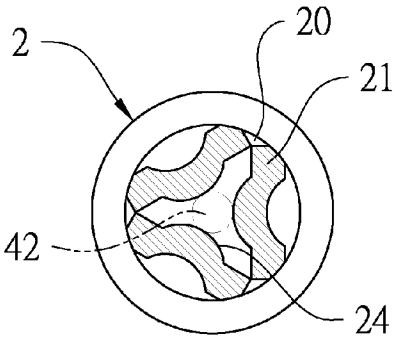
FIG. 3A is a sectional view of the tubular conductor in the embodiment in FIG. 3 along line a-a'.

Please refer to FIGS. 3 and 3A. Three conducting plates 21 equally separated by gaps 20 are disposed at the two ends of the tubular conductor 2 respectively, so that an accommodating groove 22 is formed between the conducting plates 21 at each of the ends of the tubular conductor 2 (as shown in FIG. 2). A middle section area of each of the conducting plates 21 is slightly depressed towards the accommodating groove 22 to form a flat bottom portion 23, and an elongated arch flange 24 is protrudingly formed on each of the flat bottom portions 23 facing towards the accommodating groove 22.

Thereby, when the two ends of the body 1 are connected with the connector 41 of the coaxial cable 4 respectively, cores 42 of the coaxial cables 4 are inserted into the accommodating grooves 22 at the two ends of the tubular conductor 2 through the through holes 31 of the insulation linings 3, and the cores 42 of the coaxial cables 4 inserted in the accommodating grooves 22 can be elastically clamped by the arch flanges 24 of the conducting plates 21 of the tubular conductor 2. Therefore, a pressure is exerted by the evenly separated arch flanges 24 on the cores 42 in order that tight contacts are formed between the arch flanges 24 and the cores 42. At the same time, the coaxial cable cores 42 at the two ends of the tubular conductor 2 are electrically connected, and electrical continuity is achieved between shielded portions (not shown in the drawings) of the coaxial cables 4 at the two ends of the body 1.

By forming the arch flange on the flat bottom portion at the middle section area of each of the conducting plates inwardly and protrudingly, the clamping stress can be concentrated on the arch flanges when the coaxial cable cores are clamped by the conducting plates at the two ends of the tubular conductor, and the stress produced by clamping can be evenly distributed on a larger area. Thereby, elastic fatigue of the conducting plates caused by long period of compression deformation can be prevented from occurring. When the cores with a smaller diameter (e.g. 0.64 mm) are inserted in the accommodating grooves after many times of inserting and unplugging of the cores with a larger diameter (e.g. 1 mm), the conducting plates at the two ends of the tubular conductor can still provide a stable clamping force. Therefore, when the coaxial cable adaptor is connected with the coaxial cable cores with different diameters (e.g. 0.64 to 1.07 mm), the loss of signal transmission of 1 GHz frequency is within 30 dB, and the loss of signal transmission of 3 GHz frequency is within 25 dB.

As a conclusion from the above, the coaxial cable adaptor of the present invention can provide dependable electrical connections, maintain good electrical contacts, and stabilize the transmission of high frequency signals.

Although the embodiments of the present invention have been described in detail, many modifications and variations may be made by those skilled in the art from the teachings disclosed hereinabove. Therefore, it should be understood that any modification and variation equivalent to the spirit of the present invention be regarded to fall into the scope defined by the appended claims.

What is claimed is:

1. A coaxial cable adaptor comprising a body, a tubular conductor disposed inside the body, and insulation linings disposed between the body and the tubular conductor, a plurality of conducting plates separated by gaps being disposed at two ends of the tubular conductor respectively, an accommodating groove being formed between the conducting plates at each of the two ends for inserting coaxial cable cores, characterized in that:

a middle section area of each conducting plate is depressed toward the accommodating groove to form a flat bottom portion, and an arch flange is disposed on the flat bottom portion and protrudingly formed on the middle section area of each of the conducting plates facing towards the accommodating groove, thereby, the coaxial cable cores inserted in the accommodating groove can be clamped tightly by the tubular conductor through the elasticity of the arch flanges of the conducting plates.

2. The coaxial cable adaptor as claimed in claim 1, wherein the arch flange is an elongated structure.

* * * * *